United States Patent [19]

Dalebout

[11] Patent Number: 4,974,832

[45] Date of Patent: Dec. 4, 1990

[54] ROWER SLANT BOARD

[75] Inventor: William T. Dalebout, Logan, Utah

[73] Assignee: Proform Fitness Products, Inc., Logan, Utah

[21] Appl. No.: 481,580

[22] Filed: Feb. 16, 1990

[51] Int. Cl.[5] ..... A63B 69/06; A63B 21/00

[52] U.S. Cl. ..... 272/72; 272/120; 272/130; 272/145; 272/DIG. 4

[58] Field of Search ..... 272/70, 72, 73, 93, 272/97, 120, 121, 123, 126, 127, 130, 134, 143, 144, 145, DIG. 4

[56] References Cited

U.S. PATENT DOCUMENTS

| | | | |
|---|---|---|---|
| 881,521 | 3/1908 | Wilson | 272/134 |
| 3,394,934 | 7/1968 | Elia et al. | 272/120 X |
| 3,892,404 | 7/1975 | Martucci | 272/120 |
| 4,369,966 | 1/1983 | Silberman et al. | 272/145 X |
| 4,383,684 | 5/1983 | Schliep | 272/120 |
| 4,655,448 | 4/1987 | Harper | 272/144 |
| 4,705,267 | 11/1987 | Jackson | 272/134 |
| 4,750,736 | 6/1988 | Watterson | 272/72 |
| 4,911,438 | 3/1990 | van Straaten | 272/72 X |
| 4,921,242 | 5/1990 | Watterson | 272/72 |

FOREIGN PATENT DOCUMENTS 2191103 12/1987 United Kingdom ..... 272/72

OTHER PUBLICATIONS

Octa-Gym Exercise Instructions—1984—Ajay Fun and Fitness.

*Primary Examiner*—Robert Bahr

*Attorney, Agent, or Firm*—Trask, Britt and Rossa

[57] ABSTRACT

An exercise machine may be positioned in a first configuration in which it may be used for rowing-type exercises and in a second configuration in which it may be used similar to a slant board. A track has a post rotatably positioned between a first position in which it extends upwardly from the track and a second position in which it extends downwardly for contact with the support surface to angulate the track from the support surface. A support cushion may be attached to the track upon which the user resides while performing slant board exercises in the second configuration and for performing other exercises in the first configuration.

22 Claims, 6 Drawing Sheets

ROWER SLANT BOARD

BACKGROUND OF THE INVENTION

1. Field:

This invention relates to exercise machines which may be reconfigured for doing multiple exercises and, in particular, it relates to a cable rower which may be reconfigured into a slant board useful for performing a variety of exercises.

2. State of the Art:

More recent rowing machines have been presented which may be reconfigured for doing exercises other than rowing-type exercises. In particular, rowing machines which use arms or oars may be reoriented between a horizontal position and a vertical position so that various lifting and overhead exercises may be performed in addition to rowing exercises. U.S. Pat. No. 4,796,881 (Watterson) is one example of such a machine.

Cable-type rowing machines are also known and are generally more compact than rowing machines with arms or oars. Cable rowing machines typically employ a handlebar which is grasped by the hands in lieu of or as the simulated oars. The handlebar is connected by a cable to a resistance device. In use, the handlebar is pulled by the user who is positioned on a seat.

SUMMARY OF THE INVENTION

The instant invention relates to a cable-type rowing machine which may be utilized for a number of exercises in addition to rowing-type exercises. The cable-type rowing machine of the instant invention has a track with a seat moveable therealong. Guide means is rotatably secured at one end of the track to rotate between a first position in which the guide means extends upwardly from the track and a second position in which the guide means extends downwardly from the track. Resistance means is mechanically associated with the track to provide resistance to the performance of exercises. A cable is connected to the resistance means and trained about the guide means for connection to a handle. A user positioned along the track may manipulate the handle away from the guide by pulling on it with the hands or feet to perform exercises. A base is secured under the track to support the track on a surface. A locking means is provided to hold the guide in the first and second positions. Also, a foot means is secured to the track proximate the front end thereof to support the user's feet with the guide means in the first position. In a preferred arrangement, the base means includes a first or rear base member positioned proximate the rear end to extend transversely with respect to said track.

The guide means is desirably a post with an outward end having a surface contacting element secured thereto. The inward end has a housing for rotatable connection to the track. The track at its front end preferably has axle guide structure with an axle about which the housing rotates. In a more preferred arrangement, the axle extends outwardly from the track; and the foot means is removably adapted thereto. Desirably, cushion structure is also selectively adaptable to the axle in lieu of the foot means. Most preferably, the axle extends transversely outwardly from the track to have a left side and a right side with a foot or the foot means or a cushion of the cushion structure positionable thereon as selected by the user.

In a preferred configuration, the locking means includes apertures formed in the housing to register with a latch pin secured to the track. A first aperture is in registry with the latch pin when the guide means is in the first position; and a second aperture is in registry with the latch pin when the guide means is in the second position.

In a more preferred construction, the guide means is sized in length to elevate the front end of the track to be at an angle from about five degrees to about 30 degrees with respect to the support surface. The guide means desirably extends upwardly in the first position at an angle from about 30 to about 90 degrees with respect to the track and downwardly from about 70 to about 90 degrees with respect to the track in the second position.

A support cushion may also be removably attached to the track by attaching means to support a user thereon. The track has a rail formed in its opposite sides to slidably receive structure of the seat means such as wheels. The attaching means is a pair of fingers spaced apart and sized to snap about the track. The fingers are elastically deformable with a snap element at their distal ends. The support cushion is most preferably tapered toward the front end of the track with pairs of fingers spaced apart along the cushion's length.

BRIEF DESCRIPTION OF THE DRAWINGS

In the drawings, which illustrate what is presently regarded as the best mode for carrying out the invention.

DETAILED DESCRIPTION OF THE INVENTION

Figure 1:
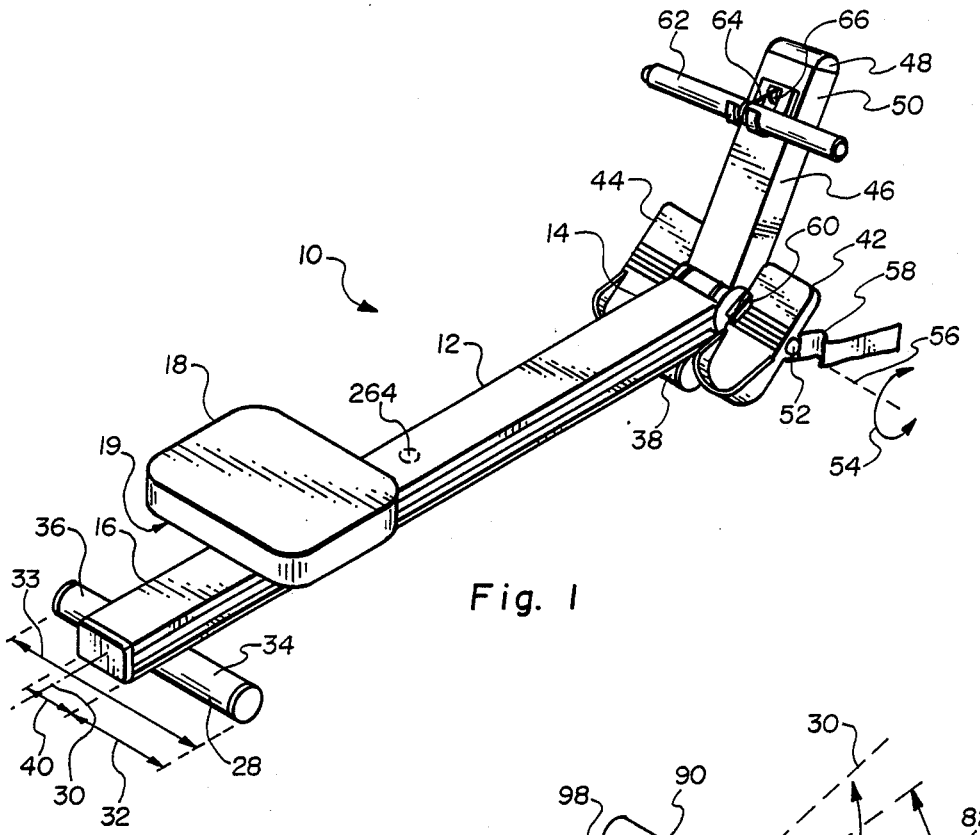
FIG. 1 is a perspective view of an exercise machine of the instant invention in its rowing configuration.

Referring to FIG. 1, an exercise machine of the instant invention includes a track 12 which has a front end 14 and a rear end 16. Seat means is associated with the track to move thereon. The seat means illustrated is seat 18 which is slidably associated with the track 12 by any convenient arrangement such as wheels 20 and 22 which are interconnected by legs 24 and 26 (FIG. 7) to the underside 19 of the seat 18.

As shown in FIG. 1, base means is secured to the track 12 to support the track 12 on a support surface such as a floor. The base means includes a first or rear base member 28 secured proximate the rear end 16 of the track 12. As can be seen, rear base member 28 is secured transverse to the longitudinal axis 30 of the track 12 to extend outwardly therefrom a preselected distance 32 on both the right side and on the left side.

Figure 2:
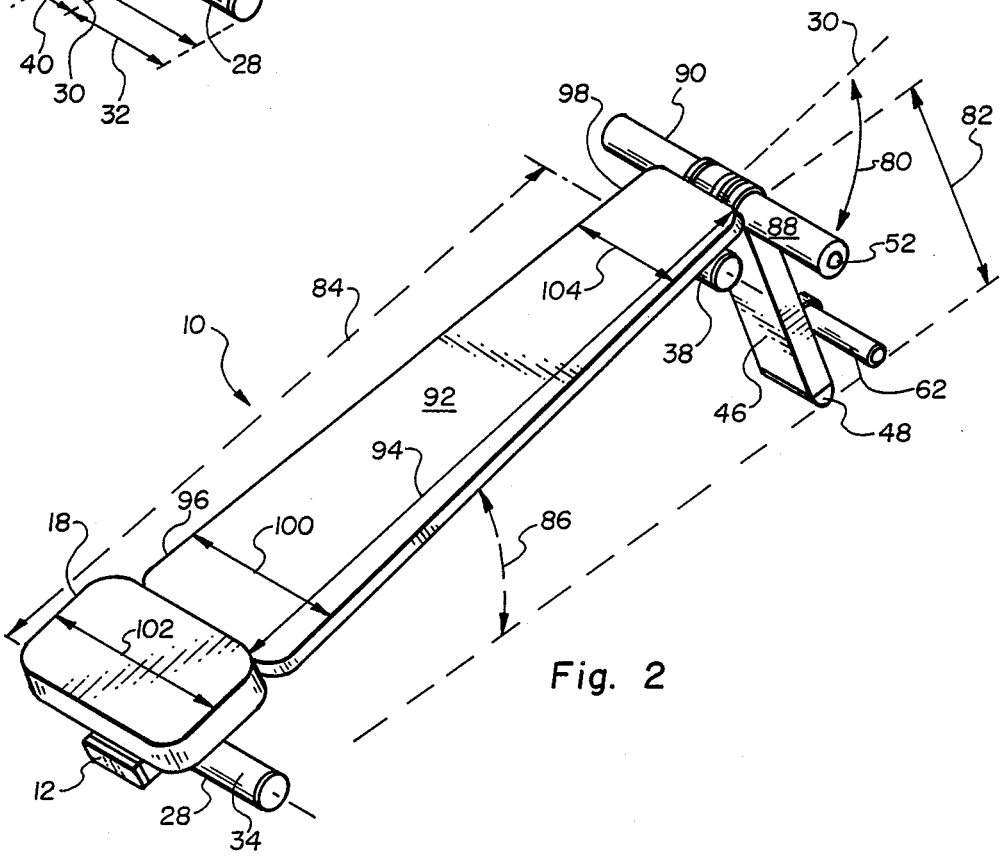
FIG. 2 is a perspective view of the exercise machine of the instant invention in an alternate or slanted configuration.

That is, the rear base member 28 has a right extension 34 and the left extension 36 each of which extend distance 32, which is selected to provide stability to the exercise machine 10 in the second configuration illustrated in FIG. 2.

In FIG. 1, the base means also includes a front base member 38 which is secured to the track 12 proximate the front end 14. As can be seen in FIG. 1, the rear base member 28 and the front base member 38 are positioned and sized to support the track 12 when the machine 10 is positioned on a substantially horizontal support surface. Front base member 38 is here shown to be a cylindrical tube which extends substantially the width 40 of the track 12. It may extend beyond the width of the track 12 so long as it does not interfere with operation of the foot means which here includes right foot support 42 and left foot support 44 as more fully discussed hereinafter.

The track 12 of FIG. 1 functions as a track for the seat 18 and as a central beam or support for the machine 10. That is, the track 12 is formed of a durable material such as aluminum of sufficient thickness and dimension to act as a support beam to support the full weight of a user positioned on the seat 18. Other configurations of beams or supports may be used to function as the track and also as the main support beam of the machine 10.

The guide means secured to the front end 14 of the track 12 is movable between a first position in which the guide means extends upwardly from the track as illustrated in FIG. 1 and a second position in which the guide means extends downwardly from the track 12 as illustrated in FIG. 2. In FIGS. 1 and 2, the guide means is a post 46 which is rotatably secured to the end 14 of the track 12. Post 46 is rectilinear in cross-section with a surface contacting member 48 secured to its outward end 50. The surface contacting member 48 may be a plastic or rubber foot to provide a high friction contact between the machine 10 and the support surface upon which it is positioned. Use of an appropriate rubber or plastic material also minimizes the risk of damage to the support surface.

In FIG. 1, it was earlier noted that foot support means includes a right foot member 42 and a left foot member 44 each positioned proximate the front end 14 of the track 12. The right foot member 42 and left foot member 44 each rotate 54 about the axis 56 of the axle 52. The user may secure his feet to the foot member 42 by use of a strap 58 with a buckle 60.

With the user seated on the seat 18, the user may pull or push him or herself to and away from the front end 14 of the track 12 by pulling and pushing on the foot support members 42 and 44 with the user's feet. When grasping the handle 62, the user in effect is performing a rowing-type exercise by pulling the handle and simultaneously pushing with his or her feet against the foot support members 42 and 44, thereby moving the seat member 18 towards the rear end 16 of the track 12. As the handle 62 is moved towards the rear end 16 of the track 12, the cable 64 moves about the guide means, and more particularly a pulley 66, rotatably secured within the post 46. The cable 64 in turn is interconnected to resistance means which is attached to the track 12 of the machine 10.

Figure 3:
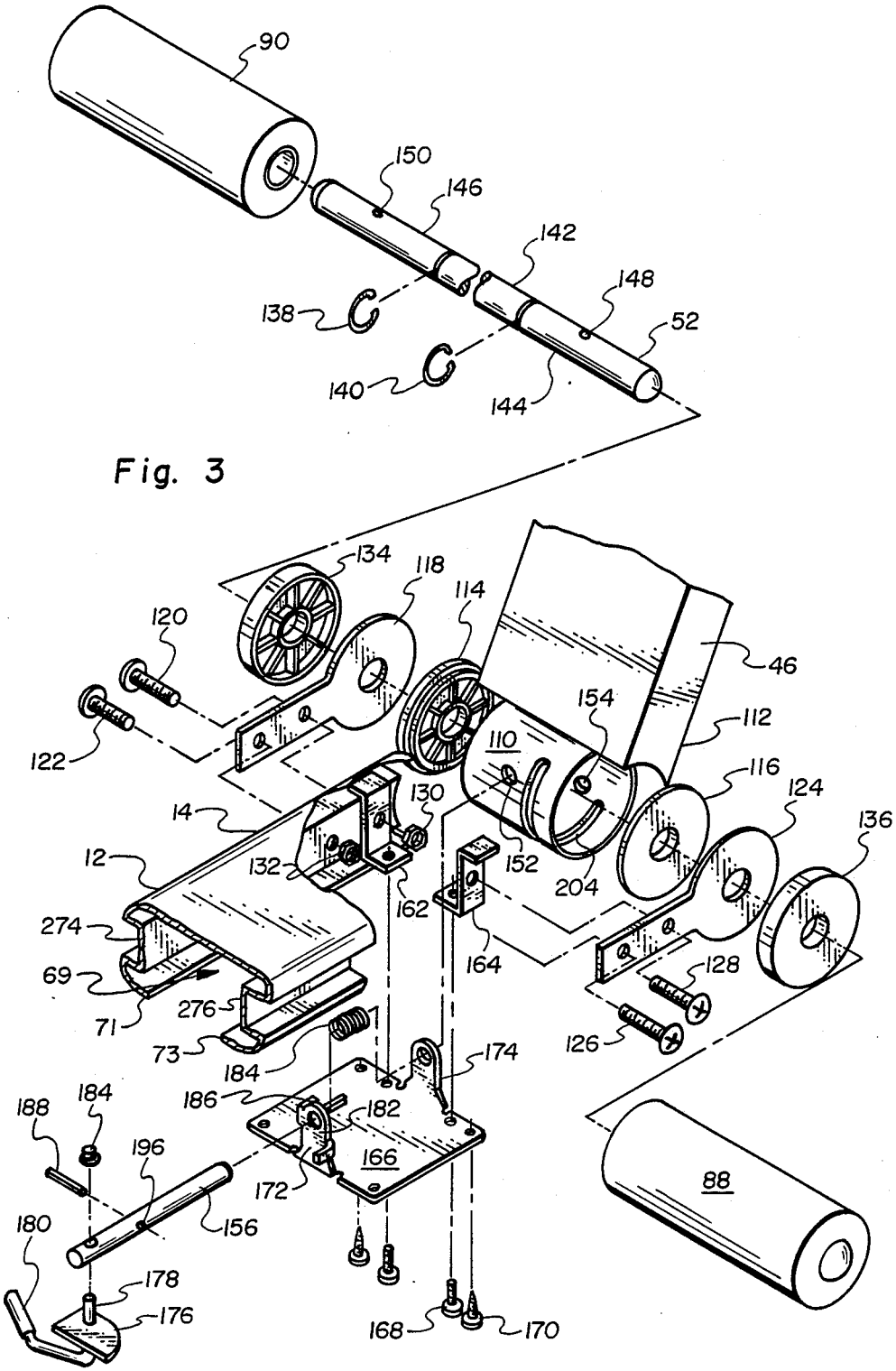
FIG. 3 is a perspective exploded view of the front end of the exercise machine of FIGS. 1 and 2.
Figure 8:
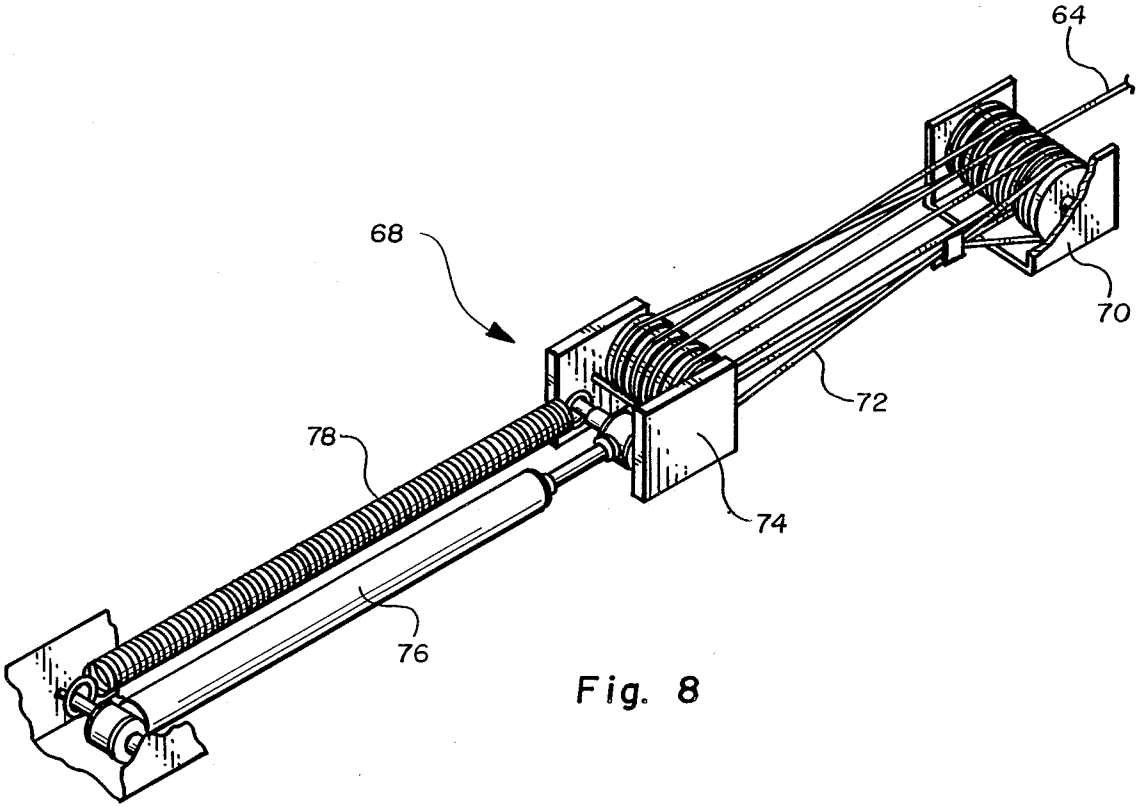
FIG. 8 is a perspective view of a resistance structure for use in the instant invention.

For the machine 1 of FIG. 1, the cable 64 is interconnected to a block and tackle resistance system 68 positioned in the track interior 69 (FIG. 8). The resistance system 68 includes blocks 70 and 74 interconnected by a plurality of lines 72. Each block 70 and 74 has multiple pulleys. Block 74 is moveable within the interior 69 along interior tracks 71 and 73 (FIG. 3). It is interconnected to a hydraulic cylinder 76 to resist movement of the block 74 and in turn cable 64, which is interwoven about the pulleys of the blocks 70 and 74. The block 70 may be fixed to the interior 69.

Referring now to FIG. 2, the exercise machine 10 of FIG. 1 is shown with the post 46 in a second position where it is positioned to extend downwardly at an angle 80 with respect to the track 12. The angle 80 is selected to be about 70 to about 90 degrees, and preferably 90 degrees. The post 46 is sized to be about 18 inches in height 82 when the track 12 is sized in length so that the distance 84 between the front base member 38 and rear base member 28 is about 40 inches. The resulting angle 86 resulting when the post 46 is in the second position as illustrated in FIG. 2 is from about 5 to about 30 degrees and preferably about 10 degrees between the track 12 and the support surface.

As can be seen in FIG. 2, the right foot support 42 and left foot support 44 had been removed from the axle 52 and replaced with cushion structure which is here comprised of a right cushion 88 and a left cushion 90. The left extension 36 and right extension 34 provide for transverse stability for the machine 10 in the configuration of FIG. 2.

In the arrangement of FIG. 2, a support cushion 92 is also included and secured to the track 12. As shown in FIG. 2, the support cushion 92 is positioned to extend along the axis 30 of the track and is sized in length 94 to extend from the front end 14 of the track towards the rear end 16 with the seat 18 positioned proximate the rear end 16 of the track 12. In the configuration of FIG. 2, the seat 18 is positioned as far to the rear on the track 12 as is permissible with the support cushion 92 extending in length 94 to be snugly abutting the seat 18 at its rear end 96 and abutting or positioned proximate the front end 98 at its other end.

It may be also noted that the support cushion 92 is tapered. That is, at its rear end 96 it is sized in width 100 to be approximately the same as width 102 of the seat 18. At its forward end 98, the support cushion 92 is sized in width 104 to be approximately the width the head of an adult user. In the embodiment illustrated, the tapered front end 98 is approximately 10 inches in width 104.

In operation, a user may be positioned in a seated position on a seat 18 with his or her feet positioned securely on the foot members 42 and 44 as illustrated in FIG. 1. The user may perform rowing exercises by pulling on the handle 62 and simultaneously pushing the seat 18 towards the rear end 16 in a rowing-type fashion. Alternately, the user may position the seat 18 towards the rear end 16 of the machine 10 in FIG. 1 and place the support cushion 92 on the track 12. The user may lay with his back on support cushion 92 and on the seat 18 to grasp the handle 62 to pull the handle 62 from above the user's head and over the user's shoulder toward the user's abdomen. Similarly, the user may stand with his or her feet positioned against the axles 52 with the foot support members 42 and 44 removed to pull upwardly on the handle 62 to perform other types of exercises including deep knee bends or the like.

In operation, the user may place the machine in the configuration of FIG. 2 and lie with his or her head towards the seat 18. The user may position the cushions 88 and 90 in the area below or under the knees with the lower legs extending downwardly from the cushions 88 and 90. The user may thereupon do sit-up type exercises. In the same position, the user may also do leg lift exercises by placing the front of his or her feet about the handle 62 and rotate the lower legs from a downward position somewhat in alignment with the post 46 to an outward position toward alignment with the axis 30 of the track 12.

In effect, the machine 10 in the configuration of FIG. 2 functions as a slant board for the performance of various slant board-type exercises, as understood and recognized by those skilled in the art. It may be noted that the width 33 of the rear base member 28 provides the machine 10 with a footprint of sufficient dimension to be stable in the performance of the exercises with the machine 10 in the configuration of FIG. 2.

Referring now to FIG. 3, the post 46 is shown with a housing 110 secured at its inward end 112. The housing 110 has a left bushing member 114 and a right bushing member 116 sized to snugly fit into the housing 110. A left axle support 118 is secured to the left side of the front end 14 of track 12 by bolts 120 and 122. A right axle support 124 is secured to the right side of the front end 14 of the track 12 by bolts 126 and 128. The bolts 120, 122, 126 and 128 are all similarly secured to the track 12 by appropriate nuts such as the illustrated nuts 130 and 132.

An exterior support bushing 134 is positioned on the left side of the left axle support 118. Similarly, a right support bushing 136 is positioned on the right side of the right axle support member 124.

As illustrated in FIG. 3, the bushings 114 and 116, the axle support members 118 and 124, and the exterior bushings 134 and 136 all have central apertures formed therein to snugly receive axle 52 therethrough. Axle 52 is held therein by snap rings 138 and 140. The central portion 142 of the axle 52 is sized in length to extend between the outer bushings 134 and 136 to be held by the snap rings 138 and 140 as illustrated.

The axle 52 is shown with a right extension 144 and a left extension 146 which extend outwardly and act as shafts to rotatably receive the foot members 42 and 44 thereover. The spring-loaded ball locks 148 and 150 are positioned in the extensions 144 and 146 to secure the right foot member 42 and the left foot member 44 thereon. Similarly, the cushions 88 and 90 are also similarly held securely and snugly on the extensions 144 and 146 by the spring loaded ball locks 148 and 150.

From FIG. 3, it can be seen that the post 46 can readily rotate about the axle 52 and more particularly the central portion 142 between the position illustrated in FIG. 1 and the position illustrated in FIG. 2.

Figure 4:
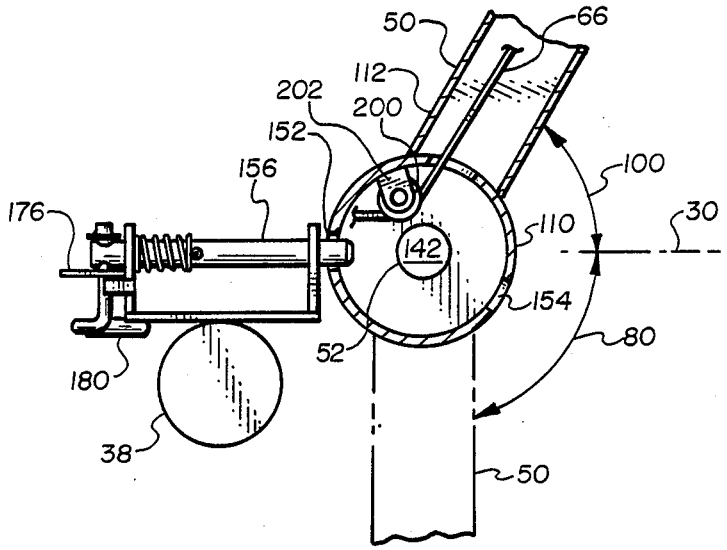
FIG. 4 is a cross-sectional view of portions of the front end of the exercise machine of FIGS. 1 and 2.
Figure 5:
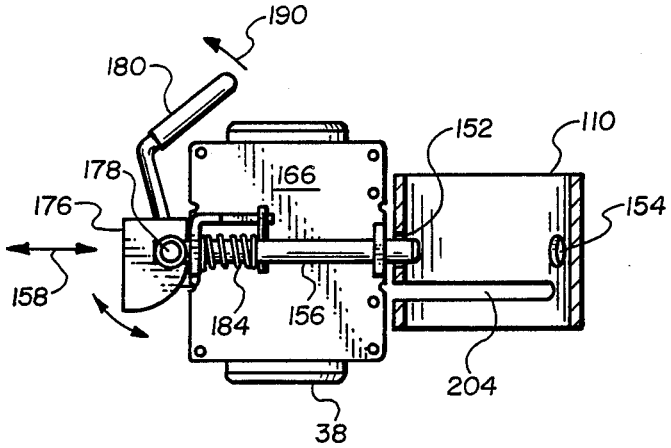
FIG. 5 is a plan view of a latching mechanism for use in the exercise machine of FIGS. 1 and 2.

The machine 10 of FIGS. 1 and 2 also includes locking means to hold post 46 in the configuration shown in FIG. 1 as well as in the position shown in FIG. 2. The locking means for the illustrated embodiment is best shown in FIGS. 3, 4 and 5. The locking means include a first aperture 152 and a second aperture 154 spaced radially from the first aperture 152 in the housing 110. A latch pin 156 is sized to slidably register with the apertures 152 and 154. The latch pin 156 may be urged inwardly and outwardly 158 to register with the apertures 152 and 154 to hold the post 46 in the first position as illustrated in FIG. 4, and in the second position as illustrated in phantom in FIG. 4.

As can be seen in FIG. 4, in the second position the post 46 is at an angle 80 with respect to the axis 30 of the track of about 90 degrees. In the first configuration, the post 46 is positioned with respect to the center line of the track 30 at an angle 160 of about 60 degrees. Additional apertures similar to apertures 154 and 152 may be formed in the housing 120 so that the post 46 may be placed in one or more additional positions between the first and second positions illustrated.

The latch pin 156 is held in alignment with the apertures 152 and 154 by a bracket structure including finger supports 162 and 164 positioned inside the track 12 and held therein by the same bolts 120 and 128 which hold the axle supports 118 and 124 as illustrated in FIG. 3. A separate base plate 166 is secured to the brackets 162 and 164 and also secured to the track 12 by appropriate bolts such as bolts 168 and screws 170.

The latch pin 156 extends through a first upright trunnion 172 and a second upright trunnion 174 to be axially aligned with the apertures 152 and 154. A cam 176 is connected to the latch pin by a shaft 178. The shaft 178 is in turn connected to handle 180 which extends away from the track 12 and which is operable between a first position and a second position. The first position is shown in FIGS. 4 and 5 in which the latch pin 156 is in registry with aperture 152. Upon rotation of the handle 180 in an outward direction, the cam 176 rotates against surface 182 of the trunnion 172 thereby urging the latch pin 156 to its second position outward from engagement with the aperture 152.

A spring 184 is positioned about the latch pin 156 and interconnected between finger 186 and a pin 188. Upon operation of handle 180 in a rearward direction 190 (FIG. 5), the spring 184 is compressed as the latch pin 156 is moved rearward 158. Upon release of the handle 180, the spring 184 urges the latch pin 156 inwardly and toward the aperture 152 in order to urge the latch pin 156 into engagement with the first available aperture. In effect, the spring 184 maintains the latch pin in positive engagement with an aperture.

The handle 180 may be secured to the latch pin 156 by a friction cap 194. The pin 188 is positioned through a corresponding aperture 196 formed in the latch pin 156. The pin 188 is held in position in the aperture 196 by the spring 184.

As best seen in FIG. 4, the cable 66 extends downward through the post 50 and is trained about a pulley 200 secured within the housing 110 by pulley bracket 202. The cable 66 is aligned to extend through slot 204 (FIG. 5) to extend rearwardly for interconnection to the first block 70 of the block and tackle resistance system 68 shown in FIG. 8. The pulley 200 guides the cable 66 with the post in the first position as shown in FIGS. 1 and 4. The axle 52 acts as a guide for the cable 66 with the post 50 in the second position shown in phantom in FIG. 4 and shown more specifically in FIG. 2.

Figure 6:
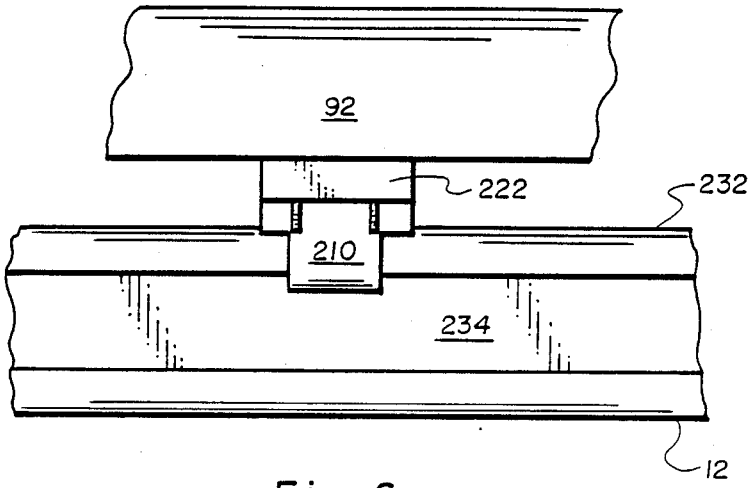
FIG. 6 is a side view of the attachment means for a support cushion attachable to the track of the exercise machine of the instant invention.
Figure 7:
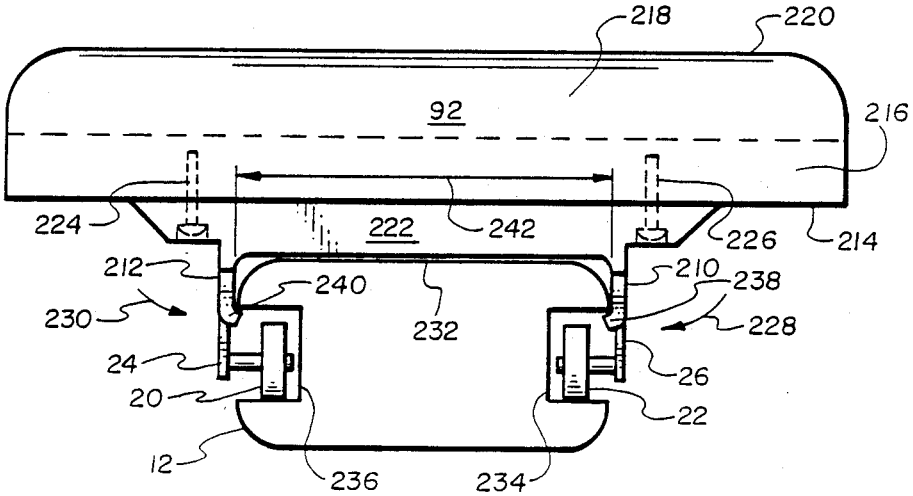
FIG. 7 is an end view of the support cushion of FIG. 6.

Referring now to FIGS. 6 and 7, the support cushion 92 is shown attached to the track 12. More particularly, the support cushion 92 has attaching means for removably attaching it to the track 12. The attaching means illustrated in FIGS. 6 and 7 includes a pair of spaced apart fingers 210 and 212 secured to the underside 214 of the support cushion 92. The support cushion 92 is preferably formed of a solid material such as a piece of plywood 216 with a foam rubber-type cushion 218 held thereon and a vinyl cover 220. The fingers 210 and 212 are held to the underside 214 of the cushion and more particularly to the plywood 216 by a bracket 222 which is in turn held in place by appropriate screws 224 and 226.

The fingers 210 and 212 are preferably formed of an elastically deformable material configured to squeeze inwardly 228 and 230 about the track 12, which is here formed with a top 232 and opposite rail cavities 234 and 236, as best seen in FIG. 7. Each finger 210 and 212 has a snap element 238 and 240 at its distal end to register with the respective rail cavities 234 and 236. The fingers 210 and 212 are spaced apart a preselected distance 242 so that the fingers 210 and 212 are squeezed about the track 12 and thereby urge the snap elements 238 and 240 into the track cavities 234 and 236 to thereby hold the support cushion 92 in place on the track 12. It may be noted that a plurality of pairs of fingers 210 and 212 may be positioned along the length 94 of the support member 92. In use, it has been found sufficient to have two pair spaced approximately 20 inches apart along the length 94 of the support member 92.

Figure 9:
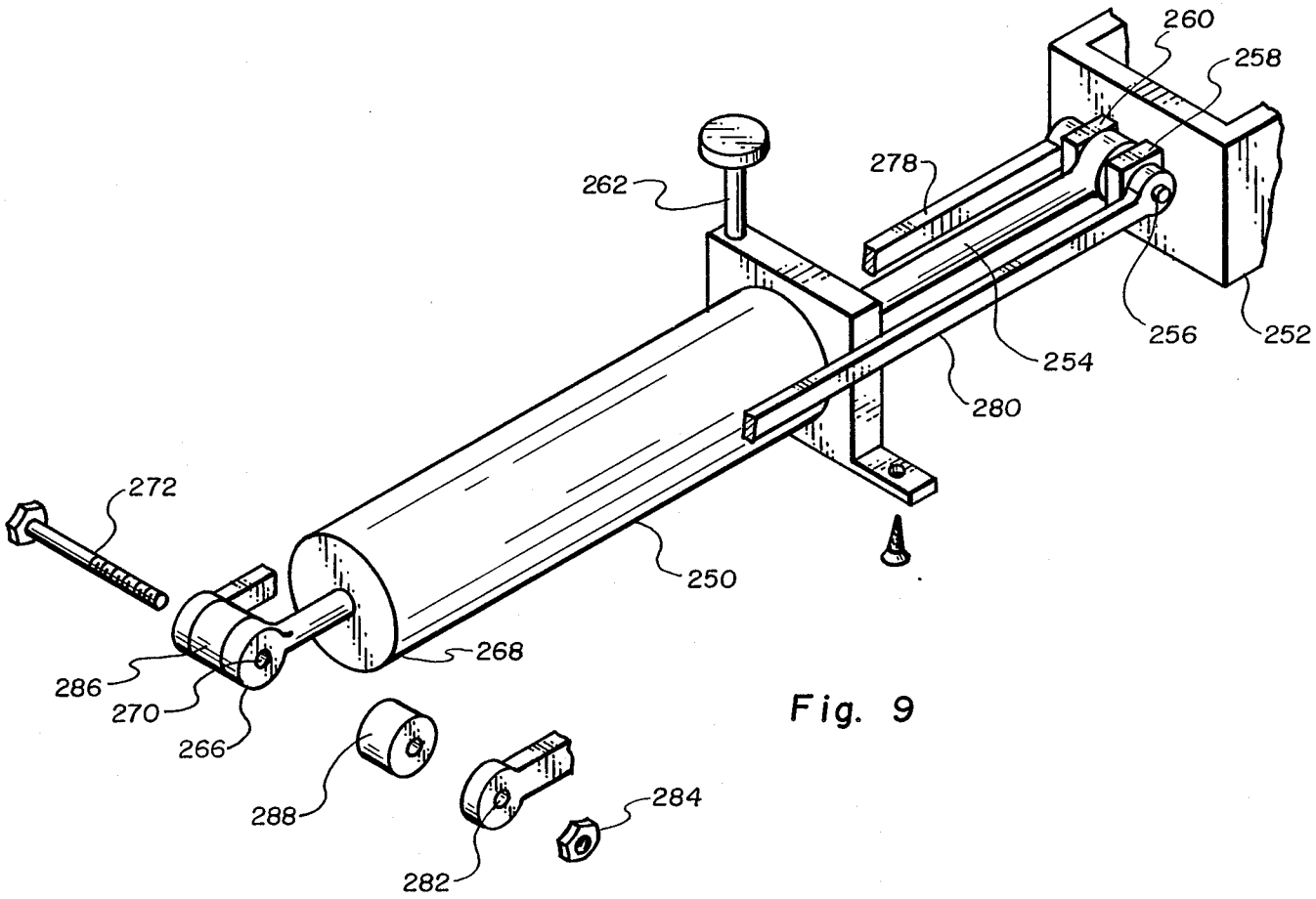
FIG. 9 is a perspective view of portions of an alternate resistance structure.

Referring now to FIG. 9, an alternate hydraulic cylinder 250 is shown connected at one end to a block 252 which is comparable to block 74 of FIG. 8. That is, block 252 has pulleys and is part of a similar block and tackle structure as shown in FIG. 8.

The cylinder 250 has a movable rod 254 extending outwardly therefrom. It is connected by a bolt 256 between two fingers 258 and 260 which extend from the block 252 which is similar to block 74 of FIG. 8. The cylinder 250 has adjustment structure in the form of a meter valve 262 has a stem which extends upward through an aperture 264 (FIG. 1) in the track 12 for operation by the user to vary the resistance of the cylinder 250 to movement of the rod 254. A connector 266 is secured to the cylinder 250 at its other end 268 for connection to the track 12 at the rear end 16 thereof. As here shown, the connector 266 has an aperture 270 through which a bolt 272 extends. The bolt 272 is sized to extend between the sidewalls 274 and 276 (FIG. 3) of the rails 234 and 237 (FIG. 7) formed in track 12.

The resistance structure of FIG. 9 also includes two elastic-like bands 278 and 280 which are connected at one end to the block 252 by the bolt 256 as shown and at the other end to the bolt 272. As shown, the elastic-like bands 278 and 280 each have apertures such as aperture 282 to receive the bolt 272 which is held by nut 284. The elastic-like bands 278 and 280 are preferably elastomeric and spaced from the connector 266 by spacers 286 and 288 in order to maintain linear alignment of the elastic-like bands 278 and 280. In use, the cylinder 250 resists movement of the cable 64 and may be adjusted to vary the degree of resistance. The bands 278 and 280 may be rubber-like and are sized to move the blade 252 toward the cylinder 250. It can be seen that the cylinder 250 and block 252 with the elastic-like bands 278 and 280 may be substituted for or in an alternative to the cylinder 76, block 74 and spring 78 of FIG. 8.

It is to be understood that the embodiments illustrated are not intended to limit the scope of the claims which themselves recite those features which are regarded as essential to the invention.

What is claimed:

1. An exercise machine, comprising:

a track having a front end and a rear end;

seat means associated with said track to move therealong to support a user thereon;

guide means rotatably connected to said track at said front end to be rotatable between a first position in which said guide means extends upwardly from said track and a second position in which said guide means extends downwardly from said track;

resistance means mechanically associated with said track to provide resistance to the performance of exercises;

cable means connected to said resistance means to resist movement of said cable means, said cable means being trained about said guide means;

handle means connected to said cable means at the distal end thereof, said handle means being positioned proximate said guide means to be pulled away from said guide means by a user positioned along said track with said guide means in said first position and said second position;

base means secured to said track to support said track on a support surface;

locking means mechanically associated with said track and said guide means to hold said guide means selectively in said first position and said second position; and foot means secured to said track proximate said front end to support the user's feet with said guide means in said first position.

2. The exercise machine of claim 1 wherein said base means includes a rear base member positioned proximate said rear end to extend transversely with respect to said track.

3. The exercise machine of claim 1 wherein said guide means is a post having an inward end and an outward end, said outward end having a surface contacting element secured thereto for contacting said surface when said guide means is in said second position.

4. The exercise machine of claim 3 wherein said inward end of said post has a housing secured thereto for rotatable connection to said track.

5. The exercise machine of claim 4 wherein said track includes an axle guide structure and an axle at its front end, said axle structure being configured and positioned to receive said housing to rotate about said axle.

6. The exercise machine of claim 5 wherein said axle extends outwardly from said track and wherein said foot means is removably adapted thereto.

7. The exercise machine of claim 6 further including cushion structure removably positionable on said axle.

8. The exercise machine of claim 7 wherein said axle extends transversely outwardly from said track to have a left side and a right side, wherein said foot means includes a left foot support and a right foot support, and wherein said cushion structure includes a left cushion and a right cushion.

9. The exercise machine of claim 5 wherein said locking means includes a first aperture formed in said housing, a second aperture formed in said housing radially spaced from said first aperture and a latch pin secured to said track and operable to engage said first aperture and said second aperture, said first aperture being in registry with said latch pin with said guide means in said first position and said second aperture being in registry with said latch pin with said guide means in said second position.

10. The exercise machine of claim 1 wherein said guide means is sized in length to elevate said front end of said track with respect to a support surface to slant said track at an angle from about five to about thirty degrees with respect to said support surface.

11. The exercise machine of claim 10 wherein said guide means extends upwardly at an angle from about thirty degrees to about sixty degrees with respect to said support surface.

12. The exercise machine of claim 1 further including a support cushion removably positionable on said track to support a user thereon.

13. The exercise machine of claim 12 wherein said track is formed with a top and opposite sides, wherein each of said opposite sides has a rail cavity formed therein and wherein said seat means has structure configured to register with said rails.

14. The exercise machine of claim 13 wherein said support cushion includes attaching means for removably attaching said support cushion to said track.

15. The exercise machine of claim 14 wherein said attaching means includes a pair of fingers spaced apart to transversely fit about said track, each finger being elastically deformable to squeeze inwardly about said track.

16. The exercise machine of claim 15 wherein each finger has a snap element at its distal end to register with its respective rail cavity.

17. The exercise machine of claim 16 wherein said support cushion has a plurality of pairs of fingers longitudinally spaced along said support cushion.

18. The exercise machine of claim 17 wherein said support cushion is sized to extend between said front end and said seal means positioned proximate said rear end.

19. The exercise machine of claim 18 wherein said support cushion is tapered along its length to have a width at the end positioned at the front end of said track about the width of a user's head.

20. The exercise machine of claim 1 wherein said guide means is positionable in at least one more position between said first position and said second position.

21. The exercise machine of claim 1 wherein said resistance means has means operable by the user to vary the resistance of the resistance means.

22. An exercise machine, comprising:

a track having a rear end and a front end;

a front foot secured to and under said track proximate its front end to support said track on a support surface;

a rear foot secured to and under said track proximate its rear end to support said track on a support surface;

axle structure secured to the front end of said track, said axle structure including an axle extending outwardly from said track to form a left shaft and a right shaft;

a post secured to said axle structure to rotate between a first position in which said post extends upwardly from said support surface at an angle from about 30 degrees to about 60 degrees with respect to said track and a second position in which said post extends downwardly from said track at an angle from about 60 degrees to about 90 degrees from said track;

a left and a right foot support each removably positionable on the respect left and right shafts;

left and right cushion structure each removably positionable and interchangeable with said left and right foot supports on the respective left and right shafts;

a bench removably positionable on said track to support a user thereon;

seat means attached to said track to move therealong;

resistance means mechanically associated with said track to provide resistance to the performance of exercises;

cable means connected to said resistance means to resist movement of said cable means, said cable means being threaded about said post;

handle means connected to said cable means at the distal end thereof, said handle means being positioned proximate said post to be pulled away therefrom by a user positioned along said track;

locking means mechanically associated with said track and said post to hold said post in said first position and said second position; and a bench cushion positionable on said track means to support a user thereon.

* * * * *